US009095172B2

(12) United States Patent
Salmon et al.

(10) Patent No.: US 9,095,172 B2
(45) Date of Patent: Aug. 4, 2015

(54) METHOD OF PROCESSING TOBACCO LEAVES

(75) Inventors: Brian Salmon, Vevey (CH); Osny Gilmar Konrath, Venancio Aires (BR)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 13/984,933

(22) PCT Filed: Feb. 16, 2012

(86) PCT No.: PCT/EP2012/000686

§ 371 (c)(1), (2), (4) Date: Sep. 23, 2013

(87) PCT Pub. No.: WO2012/110240

PCT Pub. Date: Aug. 23, 2012

(65) Prior Publication Data

US 2014/0318556 A1 Oct. 30, 2014

(30) Foreign Application Priority Data

Feb. 18, 2011 (EP) ..... 11001350

(51) Int. Cl.
*A24B 5/04* (2006.01)
*A24B 5/06* (2006.01)
*A24B 5/10* (2006.01)

(52) U.S. Cl.
CPC ... *A24B 5/04* (2013.01); *A24B 5/06* (2013.01); *A24B 5/10* (2013.01)

(58) Field of Classification Search
CPC ..... A24B 5/10; A24B 5/06
USPC ..... 131/313, 314, 322
See application file for complete search history.

(56) References Cited

U.S. PATENT DOCUMENTS

| | | | | |
|---|---|---|---|---|
| 1,861,705 A | | 6/1932 | Green | |
| 2,398,450 A | | 4/1946 | Rundell | |
| 2,747,582 A | * | 5/1956 | Willy et al. | 131/322 |
| 2,759,483 A | * | 8/1956 | Slovic | 131/314 |
| 3,696,817 A | | 10/1972 | Bonner | |
| 4,273,140 A | | 6/1981 | Eijsermans | |
| 4,449,540 A | | 5/1984 | Marshall | |

(Continued)

FOREIGN PATENT DOCUMENTS

| | | |
|---|---|---|
| DE | 879 818 C | 6/1953 |
| EP | 0 539 064 | 4/1993 |

(Continued)

OTHER PUBLICATIONS

European Search Report Application No. 11 00 1350 dated Jul. 13, 2011.

(Continued)

*Primary Examiner* — Anthony Calandra
(74) *Attorney, Agent, or Firm* — Mueting, Raasch & Gebhardt, P.A.

(57) ABSTRACT

The present invention relates to a method of processing whole tobacco leaves with stem, veins, and lamina material. The whole tobacco leaves are tipped, in order to receive tips and butts. The tips and butts are then separated. The separated tips are further processed by cutting or shredding, in order to receive light and heavy tip material. Once the light tip material is separated from the heavy tip material, the light tip material is dried, before it is finally packaged.

7 Claims, 4 Drawing Sheets

(56) References Cited

U.S. PATENT DOCUMENTS

Figure 1:
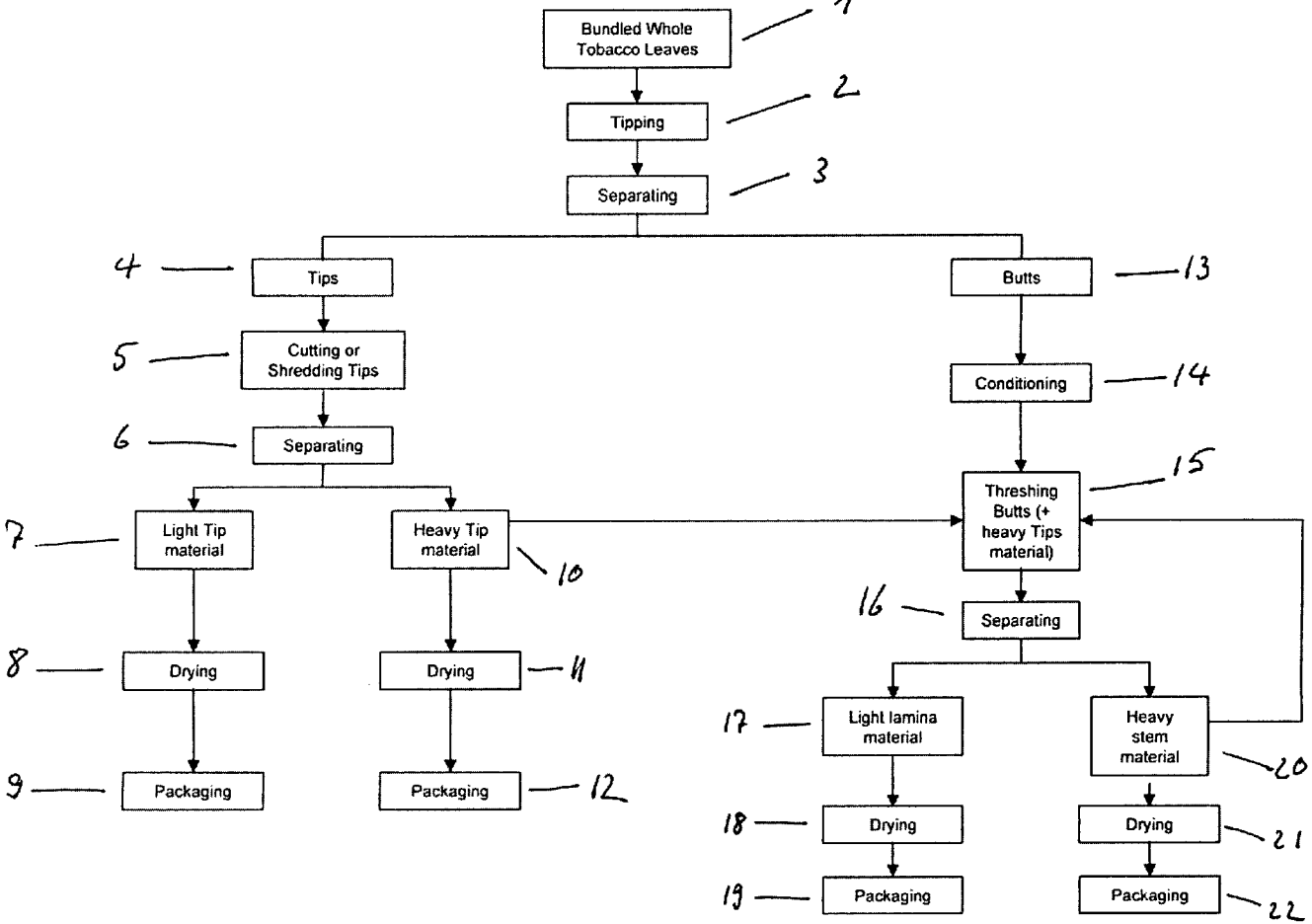

| | | | |
|---|---|---|---|
| 4,557,278 | A | 12/1985 | Brackmann |
| 4,566,470 | A | 1/1986 | Brackmann |

FOREIGN PATENT DOCUMENTS

| | | |
|---|---|---|
| EP | 0118981 | 9/1994 |
| GB | 1 062 350 | 3/1967 |
| WO | WO 90/05034 | 5/1990 |
| WO | WO 98/26676 | 6/1998 |

OTHER PUBLICATIONS

PCT/EP2012/000686 International Search Report dated May 16, 2012 (4 pages.).

* cited by examiner

METHOD OF PROCESSING TOBACCO LEAVES

This application is a U.S. National Stage Application of International Application No. PCT/EP2012/000686, filed Feb. 16, 2012, which was published in English on Aug. 23, 2012 as International Patent Publication WO 2012/110240 A1. International Application No. PCT/EP2012/000686 also claims priority to European Application No. 11001350.5, filed Feb. 18, 2011.

The present application relates to a method of processing tobacco leaves. In particular, the present invention relates to a method of processing tobacco leaves through cutting and shredding.

The varieties of tobacco delivered after harvesting, curing or other processing includes whole tobacco leaf, farmer hand-cut tobacco, butted loose leaf tobacco, butt and cut tobacco, hand strips of tobacco, whole tobacco leaf threshed, or tip-end threshed tobacco. Processing of cured or uncured tobacco varies depending on the intended use of the product.

Whole tobacco leaves usually consist of stem, veins and lamina material. In the manufacturing of machine-made smoking articles, the whole tobacco leaf is processed in a series of steps to create cut-filler for use in the smoking articles. Usually, it is important that the cut-filler tobacco consists primarily of lamina material. Stem and vein material, which is part of the whole tobacco leaf, needs to be separated as the stem and vein material could make it difficult to manufacture machine-made smoking articles. Stem and vein material can also impact the flavor and physical quality of the machine-made smoking articles. For other types of tobacco products, particularly roll your own and make your own products, a certain content of stem material might be available in the tobacco, in order to provide stability to the hand rolled cigarette.

The separation of lamina material from stem material on the tobacco leaf is usually performed in a stemmery. The stemmery receives tobacco leaves in bailed or bundled form from the tobacco fields. The weight of such bale, delivered from the farmers, might vary from 35 to 300 kilograms, while tobacco bundles usually comprise 25 to 30 tobacco leaves, which are tied together.

Once delivered to the stemmery, the tobacco leaves usually undergo several threshing and separating procedures. Typically, five threshers are positioned in a line. The threshers include rotors with selectively spaced metal teeth and threshing baskets. The tobacco leaves are fed into the threshers, where the lamina material is forcibly threshed from the stem material. After threshing, the combined lamina and stem material is guided towards separators, which are able to separate the light lamina material from the heavy material. This is usually done through the use of an airflow. While the light lamina material is further transferred to another process such as a drying or packaging, the heavy material continues to be processed by the subsequent threshing machine. The threshing of heavy material is usually repeated several times so that the available lamina material is separated from the stem material.

Alternatively, before the whole tobacco leaves are guided through the threshers the leaves may be fed through a tipping process. The tipping process consists of cutting the tip end material of the leaf from the butt material. The tip end material has a low stem content and consists of approximately 25% of the tobacco leaf. The butt material consists of approximately 75% of the tobacco leaf including the major stem and remaining lamina material. After the tipping process, the tip end material can be separated and transferred for further processing including threshing, drying or packaging. The butt material can then be conditioned by steam, in order to reach a certain content of moisture required for further processing. After the conditioning of the butt material, it is guided to a thresher to forcibly thresh and separate the lamina material from the stem material. The threshed material can then be guided to a separator to be separated into light lamina material and heavy material. The heavy material may be further guided to another threshing stage. Typically, the threshing stages would repeat until the most available lamina material has been threshed from the stem or butt material.

In the threshing stages as described above, the tobacco material is treated very roughly by the threshers and the threshing process. This results in the tobacco material potentially losing some flavor. It can also result in the threshed lamina material reaching such a rough particle form that it cannot be easily further processed in the manufacturing of machine-made smoking articles. Further, a largely and costly footprint for the alignment of several threshing stages is required. Another disadvantage is the noise, which is produced during the threshing process. Finally, as the threshing baskets of the threshers have to be driven with a very high rotation speed, the threshers are consuming a lot of energy.

U.S. Pat. No. 4,449,540 A describes a process for separating the lamina portions of baled tobacco leaves from stem portions thereof, wherein baled tobacco leaves are conveyed towards cutting means in such a way that the baled tobacco leaves are conveyed in a direction transverse of its length. Thereby, the tobacco leaves are cut crosswise to their length.

It would be desirable to provide a method for processing tobacco leaves so that they have an improved, gentler separation of lamina material from stem material. It would also be particularly desirable to improve the tobacco flavor and physical quality of the tobacco. It would also be particularly desirable to reduce energy consumption and reduce the need for a significant footprint required for the process compared to a conventional stemmery processing.

The present invention is applicable to both cured and uncured tobacco, i.e. each method step comprising either processing cured or uncured tobacco leaves.

In the method of processing whole tobacco leaves according to the invention, the tobacco leaves are provided cured or uncured in the form of tangled-loose leaves, straight-laid leaves, or bundled leaves. The tangled-loose leaves are cut, baled or packaged and have no orientation structure. The straight-laid leaves are baled or packaged with a preferred orientation. Normally in straight-laid leaves, the butt end of the leaves face outwards and the tips are placed inwards to protect the lamina material of the tobacco leaves. Tobacco leaves which are provided as bundled leaves are tied at the butt end of the leaf using a single tie tobacco leaf, wherein approximately 15 to 25 leaves are tied together.

According to a first embodiment, the present invention is a method of processing segments of tobacco leaves, the segments of the tobacco leaves being either butts or tips of tobacco leaves, comprising cutting or shredding the butts or tips to obtain light and heavy butt material or light and heavy tip material, respectively, further comprising guiding the tips and/or butts of the tobacco leaves separately towards the cutting or shredding means, which comprise several circular blades, which are able to rotate. The inventive method also comprises directing the tips or butts towards the blades of the cutting or shredding means with the stem of the tips or butts being parallel to the blades rotation.

Here, based on the differential strength between lamina and stems as well as the structure and shape, the parallel orientation ensures that the stem will naturally be forced away from the cutting edges of the cutting blades. Also, it can be said that the larger the stem, the greater the reduction of stem cutting and the highest efficiency of removing lamina from the stem.

In a preferred embodiment the method further comprises: separating the light tip material from the heavy tip material; drying the light tip material; and packaging the light tip material.

The cutting and shredding processes according to the inventive method follow the physical principle of separating an object, namely the cured or uncured tobacco leaf or segments thereof, by applying compression or shearing forces. During cutting or shredding the compression or shearing forces are provided by rotating blades of cutting and shredding means. This occurs in contrast to traditional threshing processes, where tobacco leaves are separated by stripping the tobacco leaves of the lamina through the introduction of the cured or uncured leaves into a rotating thresher basket.

According to the invention, the valuable light tip or butt material are obtained through the use of a simple and low cost cutting or shredding process. Compared to common lamina separation procedures, such as threshing, the cutting or shredding of the tips or butts enables a significant reduction in energy consumption.

Additionally, because the tips or butts do not require conditioning before the cutting or shredding processes, conditioning equipment is not needed. As a result, the manufacturing costs are reduced, and less manufacturing space is required for the tobacco processing. Further, because the tips or butts are not conditioned before the cutting or shredding, the tips or butts have a reduced moisture profile than if they were conditioned. Consequently, the tips or butts will require less time in the downstream drying process. This leads to a reduction in electrical energy consumption than is used by the conventional drying process.

The conditioning of the tobacco stems during the re-conditioning step is also necessary in order to increase the moisture content of the tobacco material following the heating of the impregnated tobacco stems, during which a large proportion of the water content of the tobacco stems will typically evaporate. Following the heating step and prior to the re-conditioning step, the tobacco stems will typically have a moisture content of around 3% of volume. During the re-conditioning step the moisture content of the tobacco stems is increased to at least 10% of volume. A corresponding re-conditioning step may also be carried out on a blend of tobacco stems and tobacco lamina.

Typically, tobacco manufacturing threshers are used to separate lamina material from stem or heavy veins material. In the present invention, the tips or butts are not threshed, but rather cut or shredded in such a way that both light and heavy butt material, or light and heavy tip material are obtained respectively. Therefore, threshing machines are replaced by cutting or shredding means, which consume less energy, and do not require as significant of a manufacturing space as the threshing machines. In addition, the cutting or shredding means can improve the production area by significantly reducing the noise.

The cutting or shredding of the tips or butts described above is responsible for several technical advantages in view of common manufacturing methods.

In another embodiment the method comprises tipping the tobacco leaves, prior to the processing of the segments of the tobacco leaves in order to obtain tips and butts, and separating the tips from the butts. Preferably the method comprises separating the light tip material from the heavy tip material; drying the light tip material; and packaging the light tip material. In order to further increase the yield, the heavy tip material, which was separated from the light tip material, preferably is transferred to another shredding process and/or cutting process.

In a further improved embodiment, the method comprises separating the light butt material from the heavy butt material, wherein the light butt material is transferred into the light tip material and the heavy butt material is transferred to a further cutting or shredding operation. When the heavy butt material is reintroduced to a further cutting or shredding operation, the heavy butt material will be cut or shredded separately or together with the provided butts. The reintroduction of the heavy butt material or a mixture of the butts and the heavy butt material can be repeated several times in order to receive the most available lamina material for cigarette production. By repeating the cutting or shredding of the heavy butt material you can eliminate several threshing operations. As a result, this provides a more compact method for processing tobacco, reduces energy consumption and noise during the process, and results in a more gentle treatment of the tobacco product. Altogether, you may derive a tobacco product with an improved flavor.

It is also possible that the method comprises transferring the heavy tip material to the cutting or shredding of the butts. There, the heavy tip material is cut or shredded together with the butts material, which optionally may be conditioned prior to the cutting or shredding process. As the heavy tip material undergoes a process of cutting or shredding together with the butts material, further useful tobacco material for the production of smoking articles can be obtained.

Preferably, the guidance of the tips and/or butts can be achieved on a feeding table. The tips, separately or together with the butts, are cut or shredded by passing through the cutting or shredding means. Here, the feeding table might be equipped with different conveyor systems, which enable conveying the tobacco leaves segments uniformly through the cutting means.

In order to cut or shred the maximum amount of tobacco leaf material, preferably the cutting or shredding means extend over the full width of the feeding table. As a result, it is not possible for tobacco leaves to pass the cutting or shredding means without being cut or shredded.

In another preferred embodiment, the circular blades are positioned relative to the same rotation axis and comprise the same size, especially the same diameter.

Preferably, the blades are arranged over a length of the cutting or shredding means, such as being spaced apart from each other by 150 mm, 100 mm, 50 mm or 12.5 mm (6 inches, 4 inches, 2 inches, or 0.5 inches). Depending on the size of tobacco leaf segments, which are expected to be cut or shredded by the cutting or shredding means, the circular blades can then be spaced apart from each other at different distances. For example, the space which is installed for cutting the tips might be less than the space between the circular blades as provided for cutting or shredding the butts.

It is even possible to arrange several cutting or shredding means successively, so that the tobacco leaf material passes through several cutting or shredding means. It is advantageous to decrease the distance between the blades, so that the tobacco leaf material must pass smaller cutting means one after the other. Here, it is possible to install a first cutting or shredding means with a distance between the circular blades of 6 inches. The gap distance is then reduced in each of the following cutting or shredding means. Although, several cutting or shredding means might be used, energy consumption is comparatively small to several threshers being positioned in a line.

In another preferred embodiment of the present invention, the method comprises guiding the tips or butts towards the cutting or shredding means in an oriented direction relative to the blades rotation. By orientating the leaf material to be cut, it is possible to prevent cutting of specific leaf material, such as the stem material.

Although it might not be as efficient as the previously proposed orientation of the tobacco leaf material segments, it is also possible to direct the tips and/or butts towards the blades of the cutting or shredding means in a random formation. There is still a high efficiency of removing the lamina from the stem using a random formation with the cutting and shredding means.

Optionally, the tips or butts can also be conditioned before the cutting or shredding, in order to reach a certain moisture degree.

The efficiency of the process can be further improved, if the moisture content of the tobacco leaf material to be cut or shredded is between 14% and 18%. Moisture content between 14% and 18% might prevent the cut material from breaking and crumbling. Further, such moisture content improves the ability to cut or shred the leaf material more easily. The cut material achieves such flexibility that lamina material can be removed efficiently.

In order to transport the tobacco material from the conditioning equipment to the cutting or shredding means, such tobacco material preferably exits the conditioning cylinders onto a conveyor. The conveyor leads the tobacco material into flow tubes or shutes, such that the material is provided in a controlled manner to the cutting or shredding means.

In addition to the positioning of the cutting or shredding means onto a feeding table, the cutting or shredding means can be also located at the beginning or end of picking tables. Here, the tobacco flow is normally reduced to carry out leaf quality picking and search for non-tobacco related materials.

In a second embodiment according to the present invention, the method of processing tobacco leaves with stem, veins and lamina material, comprising cutting or shredding the tobacco leaves with cutting or shredding means to obtain both light and heavy tobacco material, wherein the cutting or shredding means comprise circular blades, which are able to rotate, wherein the whole tobacco leaves are guided towards the cutting or shredding means in an oriented direction relative to the cutting blades, directing the whole tobacco leaves towards the rotating blades of the cutting or shredding means with the stem of the whole tobacco leaves being parallel to the blades rotation.

This ensures that the stem of the whole tobacco leaf will be forced away from the cutting edge of the cutting or shredding means. As a result, the stem might be prevented from being cut and the lamina material might be separated efficiently from the whole tobacco leaves.

Preferably the method comprises conditioning the whole tobacco leaves; cutting and shredding the conditioned whole tobacco leaves with cutting or shredding means in such a way that both light and heavy tobacco material are obtained.

In another embodiment the method comprises separating the light tobacco material from the heavy tobacco material which result from the cutting or shredding process, wherein the heavy tobacco material undergoes a further cutting or shredding process, to obtain both stem material and lamina material. During the cutting and shredding process, further lamina material can be separated from the heavy tobacco material in an economic manner.

Preferably, tobacco strips are separated from the light tobacco material. The separated tobacco strips are dried and packaged.

After the tobacco strips have been separated from the light tobacco material, they can be cut or shredded in order to create cut filler material. The cut filler material is then used for machine-made cigarette production.

Preferably, the method comprises separating the stem material from the lamina material, wherein the stem material is dried, or further cut, to create cut filler material. Alternatively, the separated stem material can be rolled before it is dried or packaged.

In another embodiment the method comprises cutting and shredding the heavy tobacco material, which is left after separating the stem material.

By repeating the cutting or shredding of tobacco material, an improved yield can be achieved. This is because there still may be valuable lamina material to remove.

Several embodiments will be described with support of the following figures:

FIG. 1: A process diagram illustrating a method of processing tobacco leaves, according to the present invention, FIG. 2: A process diagram illustrating a conventional method of processing tobacco leaves, FIG. 3: A process diagram illustrating another embodiment of the present invention, and FIG. 4: A process diagram of a second embodiment, according to the present invention.

A first embodiment of the present invention is illustrated by FIG. 1, where at position 1, bundled whole tobacco leaves are provided to be further processed. At method step 2, the bundled whole tobacco leaves will be tipped, in order to receive tip and butt material. After the tipping of the bundled whole tobacco leaves, the tip material will be separated from the butt material at method step 3. Consequently, after the separating 3, tips 4 and butts 13 are received separately. From step 4 to step 5, the tips are transferred to a cutting or shredding process, where the tips are cut or shredded. Once the cutting or shredding of the tips has been achieved, the cut or shredded tips become separated at method step 6, in order to receive light tip material 7 and heavy tip material 10.

The light tip material 7 can then be brought to method step 8, where the light tip material is dried. After the drying process 8, the dried light tip material is packaged.

Similar to the light tip material 7, the heavy tip material 10 is further moved to a drying process 11. Afterwards the dried heavy tip material 10 is packaged at method step 12.

As it is further shown by FIG. 1, besides the tips 4, also butts 13 are further processed. Therefore, after the separating 3, the received butts 13 might be further processed at stage 14, where the butts are conditioned. From there, the conditioned butts are introduced to a threshing process 15.

Alternatively, also not shown in FIG. 1, the butts might be transferred to a cutting or shredding process, where the butts are cut or shredded in such a way that both light and heavy butt material are obtained.

After the threshing process 15, the threshed conditioned butts are separated at step 16, in order to receive light lamina material 17 and heavy stem material 20.

Once the light lamina material 17 is separated from the heavy stem material 20, it can be dried at 18, before it becomes finally packaged at 19. Similarly, on the other hand, the heavy stem material 20 might be transferred to a drying process at step 21, from where it can further move to a packaging process 22.

Additionally, FIG. 1 shows that the heavy tip material 10 can also be transferred to method step 15, where the heavy tip material 10 is threshed together with the conditioned butts 14.

Further, in order to receive the most available lamina material separated from the stem material, the stem material 20 can be reintroduced to method step 15, in order to get threshed an additional time.

Figure 2:
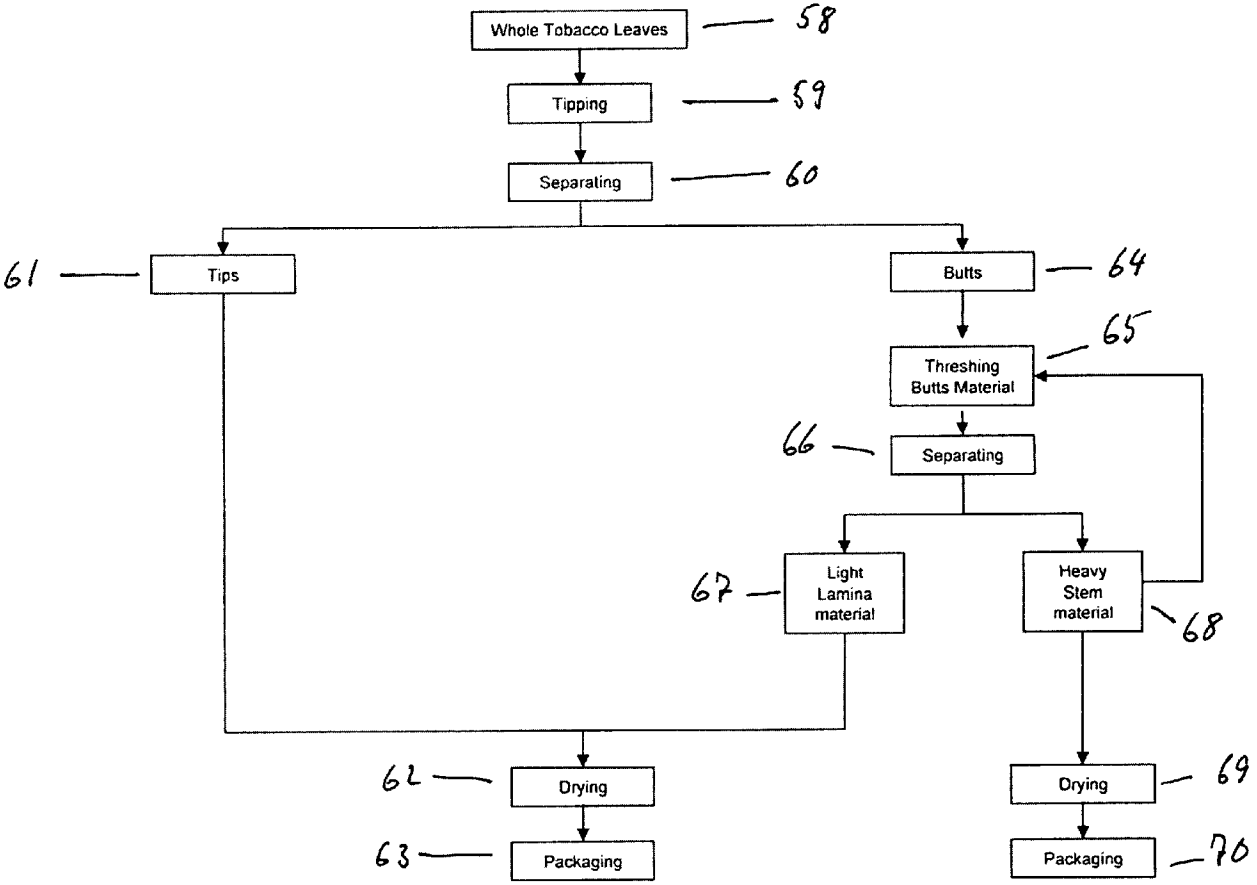
Fig. 2 Prior Art

FIG. 2 illustrates a conventional method of processing whole tobacco leaves. Whole tobacco leaves are provided at stage 58, from where they are further transferred to a tipping step at 59. After the tipping 59, the tipped material is separated at 60, namely into tips 61 and butts 64. The tips 61 are further processed with a drying operation 62. Afterwards the dried tips 61 are packaged at step 63.

On the other side, the separated butts 64 are moved into a thresher at stage 65. After being threshed, the resulted material is separated at 66 into light lamina material 67 and heavy stem material 68. From 68, the heavy stem material can be moved to a further threshing, which is indicated by the arrow back to the threshing step 65.

The tips 61 can be dried together with the light lamina material 67, the heavy stem material is dried separately at method step 69, before it becomes packaged at step 70.

Figure 3:
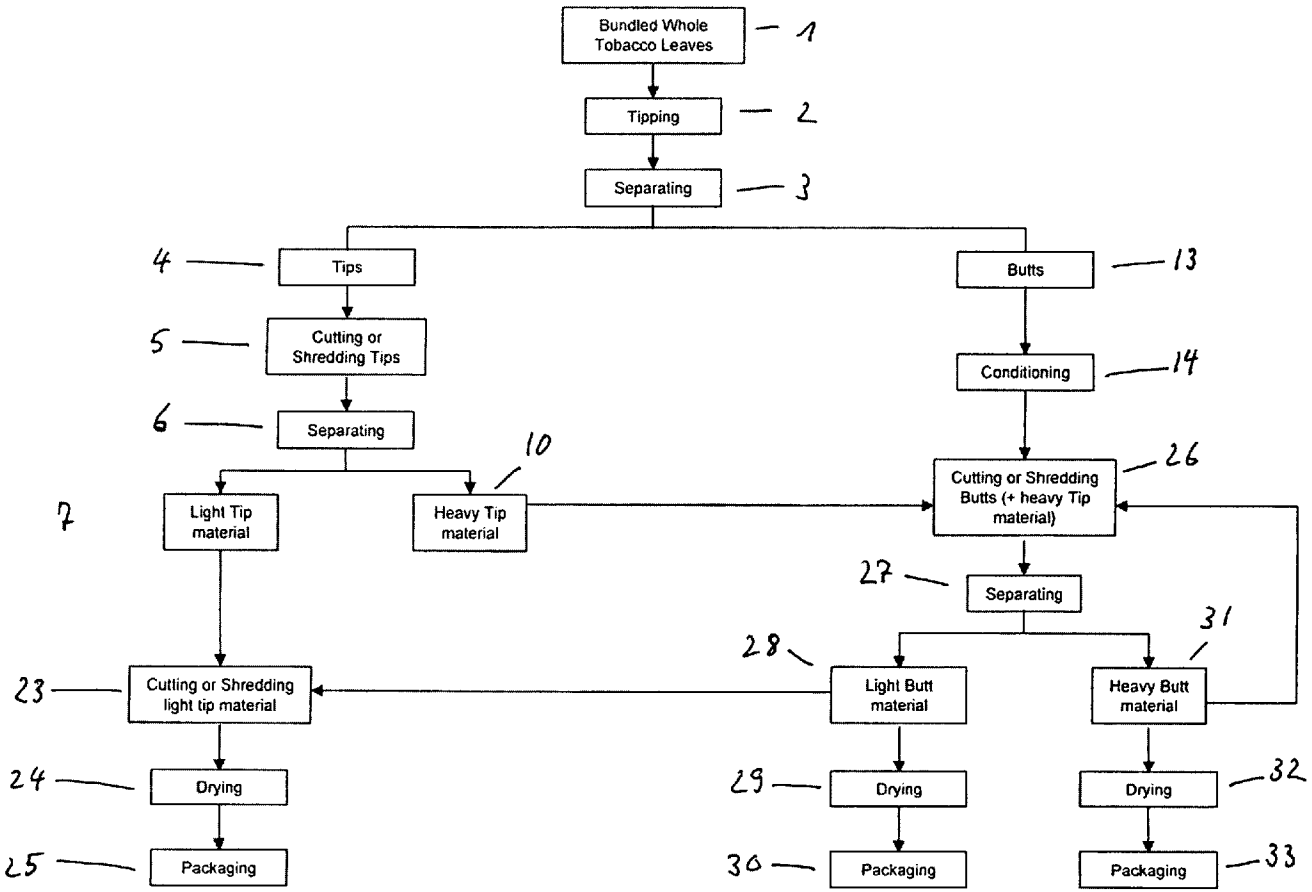

FIG. 3 illustrates another embodiment of the present invention. The method steps as provided by 1, 2, 3, 4, 5, 6, 7, 10, 13, and 14 of FIG. 1 have been maintained.

FIG. 3 further illustrates at method step 23 that the light tip material 7 is cut or shredded. This is done, in order to receive cut filler material, which will be dried at method step 24, before it gets packaged at step 25.

In contrast to the previously described embodiment of the invention, the butts, which are conditioned at step 14 will then undergo a cutting or shredding process at method step 26 in such a way that both light and heavy butt material are obtained. At 27, the cut or shredded butts will be separated into light butt material 28 and heavy butt material 31. The light butt material 28 is then further processed at step 23 by being cut or shredded together with the light tip material, or alternatively, transferred to a drying process at 29, before it is packaged at 30. On the other hand, the received heavy butt material 31 is directly moved to a drying operation 32 and then to a packaging operating 33, or alternatively reintroduced from step 31 to step 26, where it is further cut or shredded.

As it is also shown by FIG. 3 at method step 26, heavy tip material from method step 10, conditioned butts from method step 14, and heavy butt material from method step 31 can be mixed, in order to get cut or shredded. However, a separate cutting or shredding by different cutting or shredding means is also possible.

Figure 4:
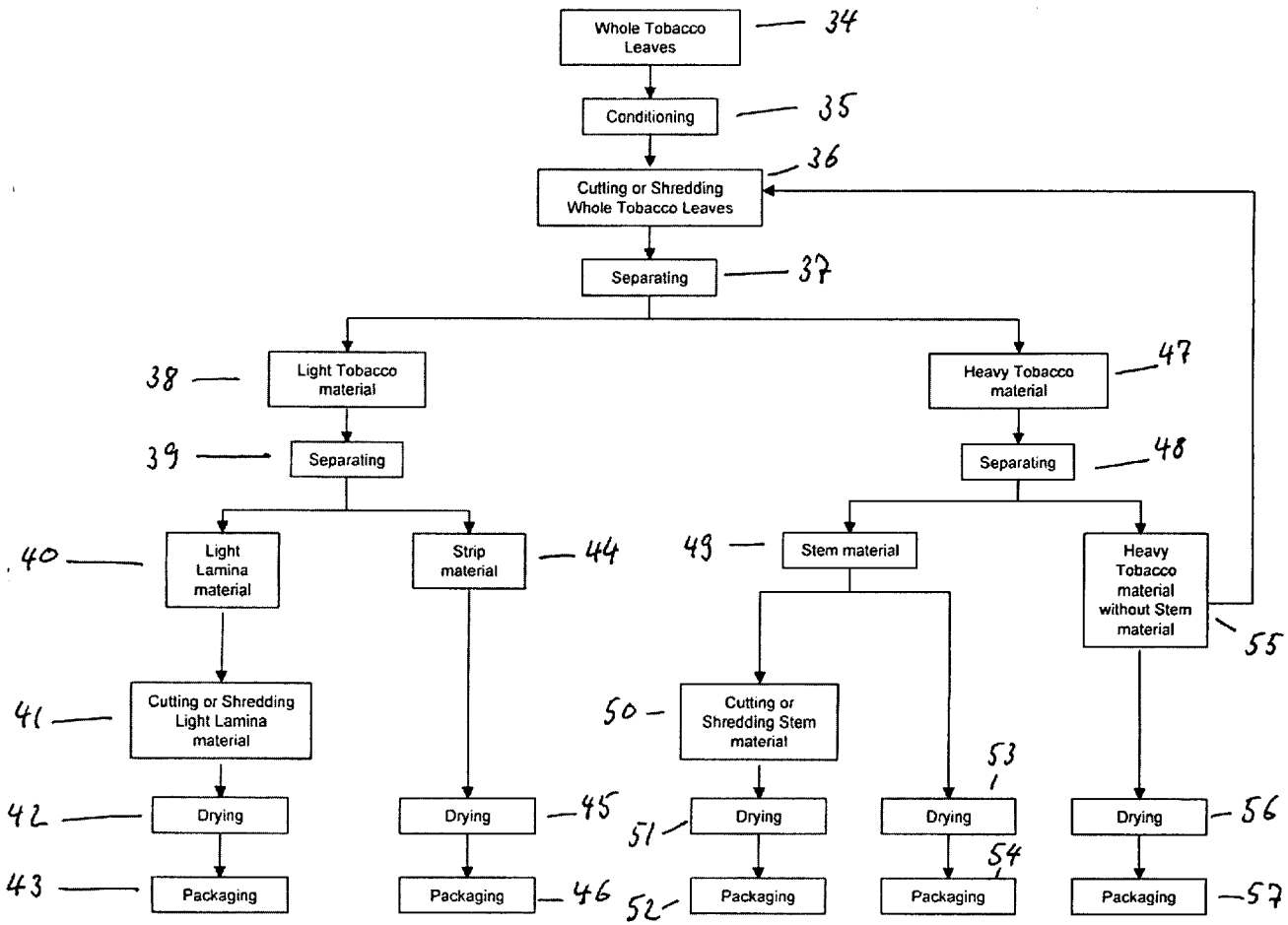

In FIG. 4, a second embodiment of the invention is described. Here, at 34, whole tobacco leaves are provided, which are moved to method step 35, where the leaves are conditioned. Once the whole tobacco leaves 34 have been conditioned at step 35, they are further transferred to a method step 36, where the whole tobacco leaves are cut or shredded in such a way that both light and heavy tobacco material are obtained. After the cutting or shredding at 36, the whole tobacco leaves are separated at method step 37, in order to receive light tobacco material at 38 and heavy tobacco material at 47.

Once the light tobacco material 38 has been separated, the light tobacco material 38 is further separated at stage 39, in order to receive light lamina material 40 and strip material 44. In order to receive cut filler material, the light lamina material from 40 is further transferred to method step 41, where the same material is cut or shredded. After the cutting or shredding of the light lamina material 41, the received cut filler material is transferred to a drying operation at 42. Once the cut filler material is dried, the dried material is packaged at 43.

On the other hand, the received strip material 44 is dried at 45, before it is packaged at 46.

After the cutting or shredding of the whole tobacco leaves at method step 36, the separated heavy tobacco material 47 also undergoes a separating process at method step 48. By the separating process 48, stem material 49 and heavy tobacco material without the mentioned stem material 55 can be received.

The received stem material from method step 49 is then further transferred to a cutting or shredding process 50, from which it is moved to a drying operating 51. After the drying operation 51, the cut or shredded stem material 50 is packaged at method step 52. Alternatively, the stem material as received by method step 49 is directly dried at method step 53, before it is packaged at 54.

The heavy tobacco material without stem material at method step 55 is further transferred to a drying operation 56, from where it moves to a packaging operation 57. Alternatively, the heavy tobacco material without stem material from 55 can be directed to a further cutting or shredding process, which is indicated by the arrow from step 55 backwards to step 36.

The present invention provides a method of processing tobacco leaves, which saves energy. In contrast to conventional tobacco leaves processing methods, the method according to the invention uses cutting or shredding processes, in order to separate the lamina material from strips or stem material of the tobacco leaves. According to the invention, the heavy stem material is forced away from the cutting or shredding means, and as a result, lamina material is separated as stem material is cut.

The present invention consists of providing controlled cutting or shredding processes, to reduce or eliminate the threshing processes of the conventional manufacturing operation. The cutting or shredding processes are applicable on cured or uncured tobacco leaves and can especially be used for several types of tobacco varieties, including Virginia, Burley, Maryland, or Oriental tobacco.

The invention claimed is:

1. Method of processing segments of tobacco leaves, the segments of the tobacco leaves being tips of tobacco leaves, comprising:

cutting or shredding the tips to obtain light and heavy tip material, respectively, guiding the tips of the tobacco leaves towards circular blades, which are able to rotate, and directing the tips towards the circular blades with a stem of the tips being parallel to the blades rotation.

2. The method according to claim 1, further comprising:

separating the light tip material from the heavy tip material;

drying the light tip material; and packaging the light tip material.

3. The method according to claim 1, comprising cutting or shredding the heavy tip material together with butts.

4. The method according to claim 2, comprising cutting or shredding the heavy tip material together with butts.

5. Method of processing segments of tobacco leaves, the segments of the tobacco leaves being butts or tips of tobacco leaves, comprising:

cutting or shredding the butts or tips to obtain light and heavy butt material or light and heavy tip material, respectively, guiding the tips or butts of the tobacco leaves separately towards circular blades, which are able to rotate, and directing the tips or butts towards the circular blades with a stem of the tips or butts being parallel to the blades rotation;

separating the light butt material from the heavy butt material, wherein the light butt material is transferred into light tip material and the heavy butt material is transferred to a further cutting or shredding operation.

6. The method according to claim 5, comprising cutting or shredding the heavy tip material together with butts.

7. Method of processing segments of tobacco leaves, the segments of the tobacco leaves being butts or tips of tobacco leaves, comprising:

cutting or shredding the butts or tips to obtain light and heavy butt material or light and heavy tip material, respectively, guiding the tips or butts of the tobacco leaves separately towards circular blades, which are able to rotate, and directing the tips or butts towards the circular blades with a stem of the tips or butts being parallel to the blades rotation;

separating the light tip material from the heavy tip material;

drying the light tip material;

packaging the light tip material; and separating the light butt material from the heavy butt material, wherein the light butt material is transferred into the light tip material and the heavy butt material is transferred to a further cutting or shredding operation.

* * * * *